United States Patent [19]

Swift

[11] Patent Number: 4,775,175

[45] Date of Patent: Oct. 4, 1988

[54] SECURITY SEAL HAVING A COLOR CODED TAMPERING INDICATOR

[75] Inventor: Allan W. Swift, Denville, N.J.

[73] Assignee: E. J. Brooks Company, Newark, N.J.

[21] Appl. No.: 176,162

[22] Filed: Mar. 31, 1988

[51] Int. Cl.[4] ..... B65D 33/34

[52] U.S. Cl. ..... 292/307 R; 292/320

[58] Field of Search ..... 292/307 R, 316, 318, 292/319, 320, 321; 109/29; 70/18

[56] References Cited

U.S. PATENT DOCUMENTS

| | | | |
|---|---|---|---|
| 3,344,757 | 10/1967 | Touyet | 109/29 X |
| 3,441,304 | 4/1969 | Chidley et al. | 292/307 R |
| 3,463,532 | 8/1969 | Chidley et al. | 292/307 R |
| 3,485,521 | 12/1969 | Moberg | 292/320 |
| 3,838,878 | 10/1974 | Fernberg et al. | 292/318 |
| 3,991,594 | 11/1976 | Goenner | 70/53 X |
| 4,226,194 | 10/1980 | Grahn | 109/29 X |
| 4,326,741 | 4/1982 | Wilson | 292/307 R |

*Primary Examiner*—Richard E. Moore

*Attorney, Agent, or Firm*—John G. Gilfillan, III

[57] ABSTRACT

A security seal having a plastic body including three elongated parallel chambers. Mating with the body is a U-shaped resilient shackle having a pair of legs each having a reversely bent end portion terminating in a sharp edge for insertion in two of the chambers. The third chamber in the body contains a frangible ampule containing a colorless liquid. A solid substance that combines with the liquid to create a third substance with a bright hue is stored in the third chamber and/or is coated on selected portions of the seal. When used to seal a structure, the shackle is threaded through the structure, and the legs are inserted into the chambers. The sharp edges of the reversely bent end portions are flexed into tight engagement with the interior walls of the chambers. In this locked position, any tampering with the security seal that would cause the shackle to move in a direction opposite to the direction in which the shackle was inserted in the body would result in the sharp edges of the reversely bent end portions penetrating the walls of the chamber, entering the third chamber, shattering the ampule, and ejecting the liquid. The ejected liquid will combine with the solid substance to form the third, brightly colored, substance to indicate tampering.

22 Claims, 2 Drawing Sheets

SECURITY SEAL HAVING A COLOR CODED TAMPERING INDICATOR

CROSS-REFERENCE TO RELATED APPLICATION

This application is related to my copending application Ser. No. 167,705 filed Mar. 14, 1988 for Security Seal with Dye.

BACKGROUND OF THE INVENTION

The present invention relates to security seals and more particularly to security seals of the padlock type that include color coded indicators for providing visual evidence of tampering.

Security seals of the padlock type are generally well known, and they hae found wide spread use as a means for sealing structures such as currency bags, closures, electric meters, and the like. Examples of such seals may be found in the following U.S. Pat. Nos.: 3,375,033; 3,485,521; 4,278,281; 4,353,583 and 4,687,240. All of these seals generally have a plastic body with a pair of spaced cavities and a U-shaped shackle having ends that are permanently locked in the cavities when the seals are used. A number of these prior art seals have been designed to produce a visual indication of tampering. For example, in U.S. Pat. No. 4,687,240, the seal body is made of a pigmented plastic of a type which produces a white blush when deformed. If tampering occurs, the shackle deforms the plastic body to produce a milky white appearance that is readily visible. Additionally, because the shackle has sharp ends to deform the plastic, the shackle ends will, in some cases, protrude from the seal body giving an added visual indication of tampering. Other examples of visual indicators may be found in the above cited prior art U.S. Pat. Nos. 4,278,281 and 4,353,583.

Although such devices have served the purpose, they have not proved entirely satisfactory under all conditions of service for the reason that a number of these seals have been defeated by people who manufacture a copy or otherwise produce a duplicate seal to be used as a replacement during tampering. Those concerned with such seals have long recognized the need of providing a security seal having a tampering indicator means that is highly visable after tampering but is highly concealed before tampering and, therefore, difficult to duplicate.

One attempt to improve the visual characteristics of security seals and discourage duplication includes the use of a colored dye that will seep from the seal onto the surrounding structures when tampering occurs. Examples of prior art devices of this nature may be found in the following U.S. Pat. Nos.: 3,991,594; 3,463,532; and 4,326,741. These patents generally describe security seals having a chamber in which a dye is stored. When the seal is broken, the chamber is penetrated with a cutting tool and the dye is ejected. As such, the dye will stain the outer surface of the tubing and/or stain the surrounding structures and even the hands of the person tampering with the tube.

The advantages of such dye filled security seals are numerous. One such advantage being that it becomes easier to determine, even from substantial distances, that the seal has been compromised. Also, such dyes can provide on-site evidence that tampering has occurred plus evidence of the person or tools used to effect the tampering. Although seals of the prior art and of my co-pending application are very useful and adequate for most purposes, there are applications where a higher degree of security is required. Thus, an enterprising thief with adequate resources can duplicate seals with dye indicators by constituting the appropriate molds and obtaining dyes or dye filled ampules with dyes of the same color as those being used. In such a case the seal can be removed by cutting the shackle and, after the protected container is violated, a new seal which is apparently identical substituted for the old seal. Needless to say that where high security is a requirement, such a possibility for successful defeat of the seal is unacceptable.

It is, therefore, an object of the present invention to provide a security seal that discourages tampering by seal duplication.

Another object of the invention is to provide a security seal that provides a distinct, highly visible indication of tampering.

Yet an additional object of the invention is to provide a security seal with dye wherein the telltale color of the dye does not become evident until after tampering.

SUMMARY OF THE INVENTION

In accordance with the present invention, a security seal has a transparent or translucent plastic body with a chamber therein. Also included in the seal body are a pair of apertures for receiving a resilient wire shackle. The shackle is generally U-shaped with legs having reversely bent, sharp ends that are dimensioned to be maintained in a flexed condition when inserted into the seal body through the apertures. The extreme ends of the bent legs are provided with sharp edges so that the ends will readily pierce the interior walls of the seal and enter the chamber upon tampering, i.e., when the shackle is moved in a direction opposite to the direction of insertion. A first material, preferably a colorless liquid, is stored in the chamber. A second material is used to coat selected portions of the seal body or is stored as a solid in the chamber. The second material is preferably of a light hue or colorless. The first and second materials are chosen, from a large set of different possible materials, such that when they combine they will create a third material that will have a bright distinctive color significantly different from the colors of the first and second materials. It is further contemplated that a plurality of such seals, each containing different combinations of materials therein, can be used as a system that will resist duplication since a particular seal in use would have a combination of materials out of the large number of possible options but known only to authorized personnel. Since each seal could turn any one of a number of different colors, a tamperer would not be sure which type of seal is being used at a particular time. Of course, when the seal is to be legitimately opened, the seal is broken and an authorized person will know if the seal in use is the proper seal if it turns to the correct color.

The exact nature of this invention will be readily apparent from consideration of the following specification relating to the annexed drawings in which:

DESCRIPTION OF THE PREFERRED EMBODIMENT

Figure 1:
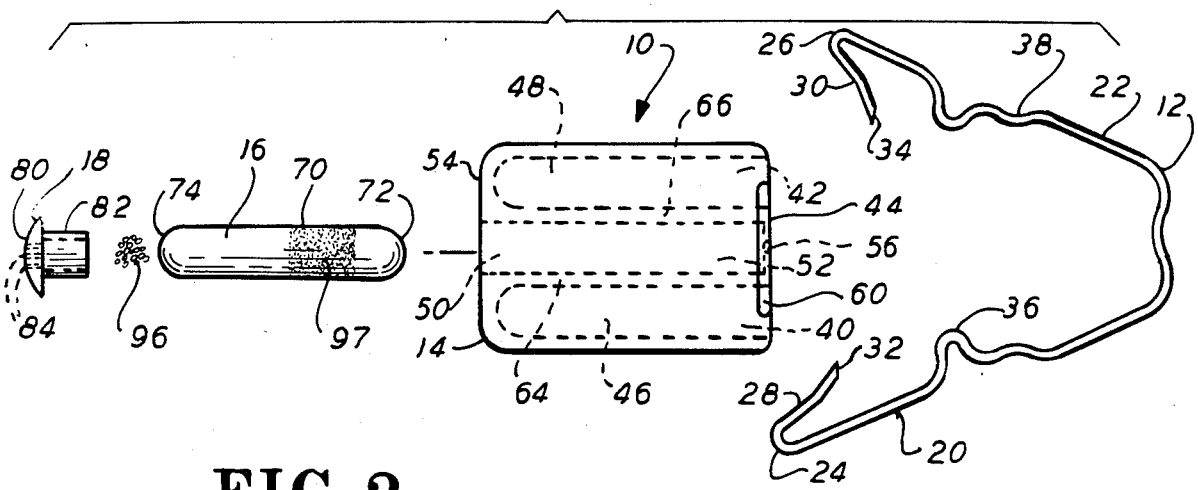
FIG. 1 shows an exploded plan view of a preferred embodiment of the invention.

Referring now to the drawings, wherein like reference characters designate like or corresponding parts throughout the several views, there is shown a security seal 10 having a shackle 12, a body 14, an ampule 16, and an end cap 18. Shackle 12, formed of spring wire and shown in FIG. 1 in its unstressed position, is generally a U-shaped structure having a long leg 20 and a short leg 22. The legs 20 and 22 have bights 24 and 26 forming reversely bent end portions 28 and 30, respectively. Formed on the extreme ends of bent end portions 28 and 30 are sharpened edges 32 and 34, respectively. Finally, the legs 20 and 22 are each bent to form inwardly protruding bumps 36 and 38, respectively.

The body 14, generally shaped as a flat rectangular block, has spaced apertures 40 and 42 extending into the body 14 from end wall 44 to form elongated chambers 46 and 48, respectively. A third aperture 50 is formed in body 14 through end wall 54 which is parallel to and located opposite end wall 44. Aperture 50 extends into body 14 to form a third chamber 52 intermediate chambers 46 and 48. Chamber 52 runs from end wall 54 to a distance just short of end wall 44. A bore 56 extends through end wall 44 into chamber 52 to define a vent hole for venting the interior of chamber 52 to the exterior of body 14 through wall 44. A pair of parallel reinforcing ribs 60 and 62 are formed on the opposite side edges of end wall 44. Chambers 46 and 52 are separated by partition 64, and chambers 48 and 52 are separated by partition 66.

Ampule 16 is constructed from a thin brittle material, such as plastic or glass, and defines a hollow elongated cylindrical body 70 having closed, generally rounded ends 72 and 74. Ampule 16 contains a first material 95 that will be later described in detail.

Cap 18 has a cylindrical sleeve 82 having an outside diameter substantially equal to the inside diameter of aperture 50. At one end, sleeve 82 is closed by a smooth rounded head 80 extending radially beyond the outside surface of sleeve 82. Holes 84 extend axially through the head 80 into the interior of sleeve 82.

Figure 2:
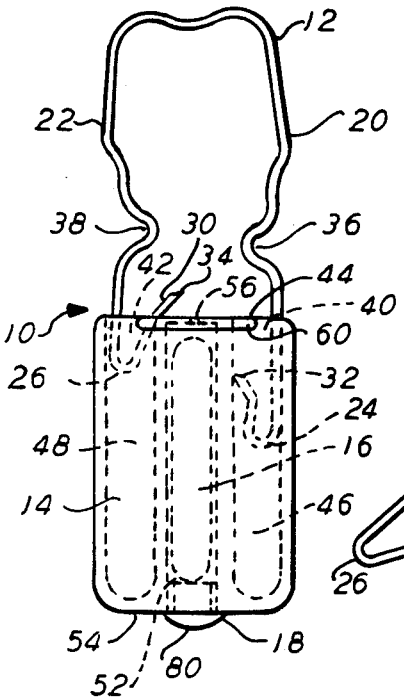
FIG. 2 shows a plan view of the device shown in FIG. 1 in a storage position.
Figure 3:
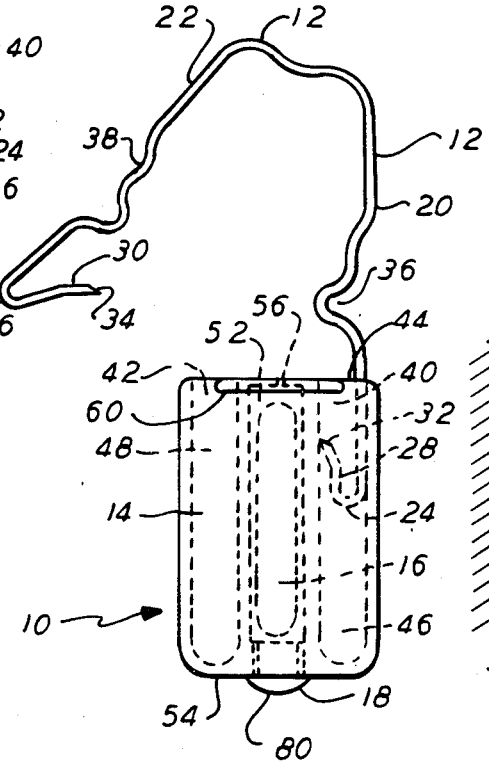
FIG. 3 shows a plan view of the device shown in FIG. 1 in an open position.
Figure 4:
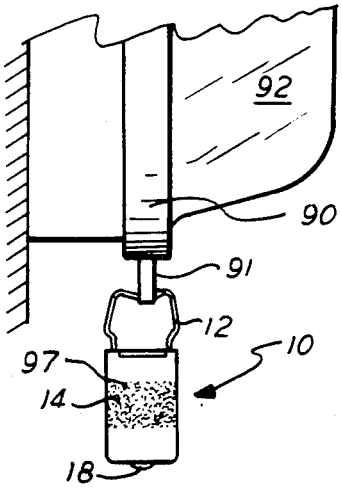
FIG. 4 shows a plan view of the device shown in FIG. 1 mounted on a structure in a locked position.
Figure 5:
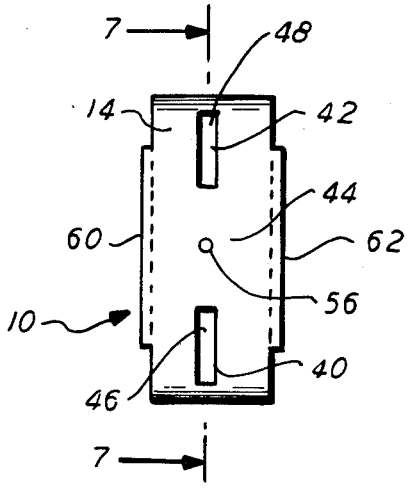
FIG. 5 is an end view of the device shown in FIG. 1.
Figure 6:
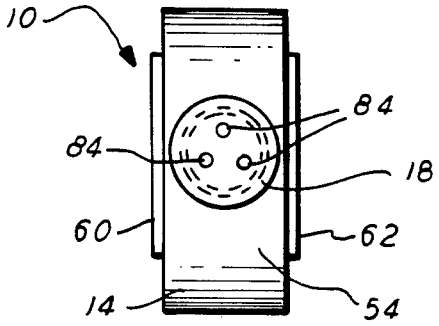
FIG. 6 is an end view of the device shown in FIG. 1.

FIG. 1 illustrates the security seal 10 before assembly, while FIG. 2 represents an assembled security seal 10 as it would normally be shipped or supplied to a user. FIG. 3 illustrates the security seal 10 in an open position, i.e., ready for mounting the seal 10 onto a structure. FIG. 4 shows a fully locked seal 10 mounted on a structure, such as an electric meter rim 90.

Assembly of the seal 10 of FIG. 1 into the assembled structure of FIG. 2 involves first sliding the ampule 16 into chamber 52 through aperture 50 and then fitting sleeve 82 of cap 18 into aperture 50 with the head 80 abutting the wall 52. Cap 18 is permanently joined to body 14 as, for example, by an ultrasonic weld or other suitable means. The shackle 12 is assembled by squeezing the spring wire legs 20 and 22, and inserting first bite 24 and then bite 26 into opposed apertures 40 and 42. As the legs 20 and 22 are forced into the apertures 40 and 42, the walls of chambers 46 and 48 will squeeze the legs 20 and 22, bend the end portions 28 and 30 at bites 24 and 26, and force the sharpened edges 32 and 34 into tight engagement against the surface of partitions 64 and 66. It is contemplated that the seal 10 could be shipped and supplied to the user in the condition shown in FIG. 2, that is, with the long leg 20 partially inserted in chamber 46 and with the bite 26, on the short leg 22, clipped in the other aperture 42. With the seal 10 in this position, the shackle 12 and body 14 are assured to remain joined, preventing other seals 10 from becoming tangled therewith during shipping. Also, with the bite 26 on the short leg 22 only slightly inserted in the body 14, the seal can be opened and put into the open position shown in FIG. 3 by simply grasping the short leg 22 and, with only minimal force, bending the bite 26 out of the aperture 42.

With the shackle 12 in the open position, shown in FIG. 3, the seal 10 is in a position to have the short leg 22 passed into the structure to be sealed, such as the lug 91 on electric meter 92, as shown in FIG. 4. After inserting the short leg 22 through lug 91, the short leg 22 is replaced in aperture 42, and the shackle 12 is fully inserted into the body 14 to the locked position shown in FIGS. 4 and 7.

Figure 7:
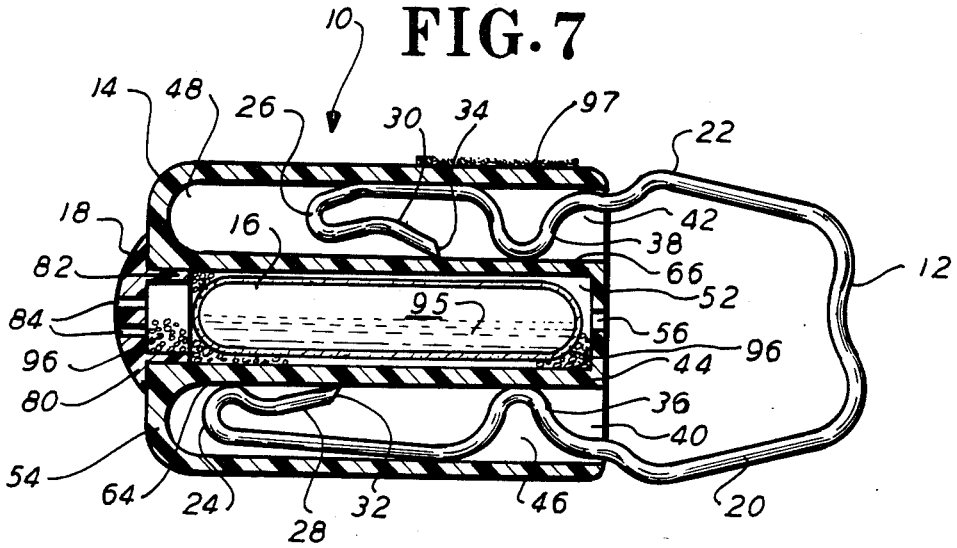
FIG. 7 is a section of the device taken on the line 7—7 of FIG. 5.

When the seal 10 is in the fully locked position of FIGS. 4 and 7, the sharpened edges 32 and 34 are in tight engagement against the partitions 64 and 66 due to the resilient nature of the spring wire material of shackle 12 and the squeezing of end portions 28 and 30 during insertion of legs 20 and 22 into body 14. Also, as can be seen in FIG. 7, when the shackle 12 is fully inserted into body 14, the bumps 36 and 38 are contained in the chambers 46 and 48, respectively. These bumps 36 and 38 are provided to block entry into the chambers 46 and 48 of a picking tool.

Figure 8:
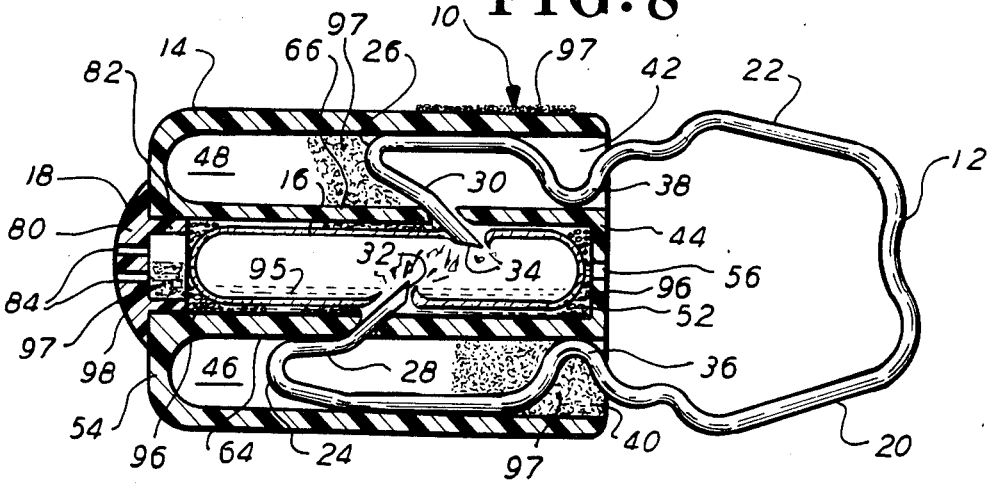
FIG. 8 is a sectional view of the preferred embodiment similar to the view shown in FIG. 7 but in a tampered position.

It is contemplated that the material, preferably plastic, of the body 14 be soft so that the partitions 64 and 66 are easily punctured by the sharpened edges 32 and 34 when any reasonable attempt is made to remove the legs 20 and 22 of the shackle 12 from the body 14. If such an attempt to remove the shackle 12 should take place, it is intended that the sharp edges 32 and 34 will puncture the partitions 64 and 66, enter the chamber 52, and shatter the brittle ampule 16 as shown in FIG. 8.

In one embodiment of the invention, a solid grannular material 96 is placed in chamber 52 along with the ampule 16. In this embodiment, the liquid 95 will seep from the ampule 16 and react with material 96 to form a third material, such as a colored liquid, that will stain the interior of chamber 52 and/or seep from the seal body 14. It is contemplated that the colored third material be visible through the walls of seal body 14.

In a second embodiment of the invention, the solid material is formed as a coating 97 on the ampule exterior 16. The liquid 95 will seep from a shattered ampule 16 and combine with the coating 97 to turn the shattered pieces of the ampule 16 a bright color that can be seen from the exterior of seal body 14. In some cases this embodiment will be most advantageous. In this embodiment the ampules 16, containing the various liquids 95, will be the only seal parts that will be different, thereby making seal assembly simple since the shackle 12 and bdoy 14 will be the same for all seals.

A third embodiment is also contemplated that involves coating selected portions of the seal 10 with the second material. A coating 97 could be placed in the seal interior including chambers 46, 48 and 52, cap 18, and elsewhere. Further, the exterior of seal body 14 could include a coating 97. Finally, it is contemplated that the entire seal 10, including the shackle, could be coated, inside and outside.

The liquid material 95 may be chosen from the many conventional chemical indicators. For example, three representative indicators are listed below. These indicators will produce the listed colors when combined with materials 96 and 97. Materials 96 and 97 may be any suitable material having a pH greater than the number listed. Sodium hydroxide (NaOH) is a preferred material.

| Liquid 95 | Initial Color | pH (96, 97) | Final Color |
|---|---|---|---|
| Phenolphthalein | Colorless | 10 | Pink |
| Thymolphthalein | Colorless | 11 | Blue |
| Bromocresol Purple | Yellow | 7 | Purple |

Of course, the granular material 96 or the coating 97 may be used either alone or together. Since the body 14 is to be constructed of transparent or translucent material, it is not necessary for the colored material to seep from the body 14 in order to be seen. The color of the third material should be readily seen through the walls of body 14. Therefore, openings 84 and 56 while preferred in some cases are not necessary.

From the above, it is manifest that a plurality of security seals can be used as a coded color system of seals that, in the untampered conditions, all look identical, but, upon tampering, can change into one of a large number of different predetermined colors. Therefore, by using the many combinations of materials listed above, a system of seals can be constructed, wherein it is rendered difficult for a tamperer to duplicate the precise seal being used since he could never be sure as to what materials were used or, put another way, what color the seal will turn when the ampule 16 is finally broken.

After seeping from the ampule 16, the liquid material 95 may also seep through the pierced openings in the partitions 64 and 66, into the chambers 46 and 48, and through apertures 40 and 42 to the exterior of body 14. It can be seen, therefore, there are provided multiple paths for the seeping liquid material 95 to reach the exterior of seal 10. Therefore, various portions of the seal body can all be selectively coated to form the combinations of options that will make each seal distinctive and, therefore, difficult to duplicate.

It should be understood, of course, that the foregoing disclosure relates to only a preferred embodiment of the invention, and that numerous other modifications or alterations may be made therein without departing from the spirit and the scope of the invention as set forth in the appended claims. For example, in the foregoing disclosure the legs 20 and 22 are described and shown as being locked in chambers 46 and 48 by virtue of the sharp edges 32 and 34 digging into the soft partitions 64 and 66. Other locking methods are also feasible, such as the use of bumps, slots, depressions, etc., that are easily penetrated when tampering occurs.

What is claimed is:

1. A security seal comprising:

a seal body having a chamber therein;

a first material contained in said chamber;

a second material contained in said seal body and separated from said first material; and means for permitting said first and second materials to combine and form a third material having a color different from the colors of said first and second materials when a force is exerted to open said seal.

2. A security seal according to claim 1 and wherein said seal body has means for permitting said third material to be seen from the exterior of said seal body.

3. A security seal according to claim 2 and wherein said first material is a colorless liquid.

4. A security seal according to claim 3 and wherein said second material is coated on a portion of said seal body.

5. A security seal according to claim 3 and further including a frangible ampule and wherein said colorless liquid is stored in said ampule.

6. A security seal according to claim 5 and wherein said second material is a solid substance stored in said chamber.

7. A security seal according to claim 2 wherein said first material is disposed within a container in said body and said second material is disposed on said container.

8. A security seal according to claim 1 and wherein said seal body has openings.

9. A security seal according to claim 8 and wherein said third material is a bright colored liquid and said openings extend between the exterior of said seal body and said chamber, whereby said third material will seep through said openings.

10. A security seal comprising:

a seal body having a chamber therein;

a first material contained in said chamber;

a second material contained in said seal body and separated from said first material; and means for permitting said first and second materials to combine and form a third material having a color different from the colors of said first and second materials when a force is exerted to break said seal.

11. A security seal according to claim 10 and wherein said seal body has means for permitting said third material to be seen from the exterior of said seal body.

12. A security seal according to claim 11 and wherein said first material is a colorless liquid.

13. A security seal according to claim 12 and wherein said second material is coated on a portion of said seal body.

14. A security seal according to claim 12 and wherein said second material is a solid substance stored in said first chamber.

15. A security seal according to claim 12 and further including a frangible ampule and wherein said colorless liquid is stored in said ampule.

16. A security seal according to claim 12 and further including a frangible ampule, said colorless liquid being housed in said ampule and said second material being coated on said ampule.

17. A security seal according to claim 10 and wherein said seal body has openings.

18. A security seal according to claim 17 and wherein said third material is a bright colored liquid and said openings extend between the exterior of said seal body and said third material, whereby said third material will seep through said openings.

19. A security seal comprising:

a U-shaped shackle having first and second legs, each having a reversely bent end portion;

a seal body having spaced elongated first and second generally parallel chambers, each terminating in an aperture located in a common wall on said seal body for receiving a different one of said legs;

a third chamber positioned in said body adjacent said first and second chambers and separated therefrom with first and second partitions, respectively;

a first material contained in said third chamber;

a second material contained in said seal body and normally separated from said first material; and means in said chambers for locking said shackle in said chamber and for causing said reversely bent end portions to penetrate said partitions and permit said first and second materials to combine when a force is exerted to unlock said shackle.

20. A security seal according to claim 19 and further including a frangible ampule and wherein said second material is a solid substance stored in said third chamber and said first material is a colorless liquid stored in said ampule.

21. A security seal according to claim 20 and wherein said second material is coated on said ampule.

22. A security seal according to claim 19 and wherein said seal body has openings, said third material is a bright colored liquid, and said openings extend between the exterior of said seal body and said third material, whereby said third material will seep through said openings.

* * * * *